US005860314A

United States Patent [19]

Powers, III

[11] Patent Number: 5,860,314

[45] Date of Patent: Jan. 19, 1999

[54] STRETCH BEND FORMING APPARATUS, METHOD AND PRODUCT FORMED THEREBY

[76] Inventor: John Powers, III, 4446 E. Flower, Phoenix, Ariz. 85018

[21] Appl. No.: 725,128

[22] Filed: Oct. 2, 1996

[51] Int. Cl.[6] ..... B21D 11/02

[52] U.S. Cl. ..... 72/297; 72/302

[58] Field of Search ..... 428/182; 72/296, 72/297, 302, 379.6

[56] References Cited

U.S. PATENT DOCUMENTS

| | | | |
|---|---|---|---|
| 2,459,132 | 1/1949 | Nielsen | 153/48 |
| 2,503,874 | 4/1950 | Ives | 154/33.05 |
| 2,515,734 | 7/1950 | Rathgen | 153/32 |
| 2,553,092 | 5/1951 | Hubbert | 153/48 |
| 2,676,638 | 4/1954 | Wheeler et al. | 153/32 |
| 2,692,634 | 10/1954 | Green | 153/48 |
| 2,759,513 | 7/1956 | Green | 153/48 |
| 2,830,644 | 4/1958 | Walker et al. | 153/32 |
| 3,335,932 | 8/1967 | Brown | 229/14 |
| 3,908,428 | 9/1975 | Mackenzie | 72/296 |
| 3,990,288 | 11/1976 | Mackenzie | 72/296 |
| 4,471,014 | 9/1984 | Den Hartog et al. | 428/182 |
| 5,093,178 | 3/1992 | Sundstrom et al. | 428/156 |
| 5,390,538 | 2/1995 | Spath | 72/133 |
| 5,410,904 | 5/1995 | Hirata et al. | 72/446 |
| 5,417,097 | 5/1995 | Kojima | 72/335 |
| 5,431,985 | 7/1995 | Schilling | 428/182 |
| 5,464,171 | 11/1995 | Ripplinger | 242/609.1 |
| 5,464,577 | 11/1995 | Leonard et al. | 264/40.5 |
| 5,466,146 | 11/1995 | Fritz et al. | 425/389 |
| 5,489,463 | 2/1996 | Paulson | 428/174 |

FOREIGN PATENT DOCUMENTS

| | | | |
|---|---|---|---|
| 610081 | 12/1960 | Canada | 72/297 |
| 621185 | 5/1961 | Canada | 72/297 |
| 484918 | 4/1975 | U.S.S.R. | 72/296 |

*Primary Examiner*—Nam Nguyen
*Assistant Examiner*—Steven H. VerSteeg
*Attorney, Agent, or Firm*—Parsons & Goltry; Robert A. Parsons; Michael W. Goltry

[57] ABSTRACT

A method and apparatus for stretch bend forming of sheet stock and the product formed by either the apparatus or method. The method for stretch bend forming of sheet stock includes steps of (i) clamping a first portion of the sheet stock in a first clamp, (ii) clamping a second portion of the sheet stock in a second clamp, wherein the first and second clamps are in a first position, (iii) moving a mandrel a first distance in a first direction to bring the mandrel into contact with a third portion of the sheet stock, the third portion of the sheet stock disposed between the first and second portions of the sheet stock and (iv) moving the mandrel a second distance in the first direction to bend the third portion of the sheet stock.

23 Claims, 16 Drawing Sheets

FIG. 16
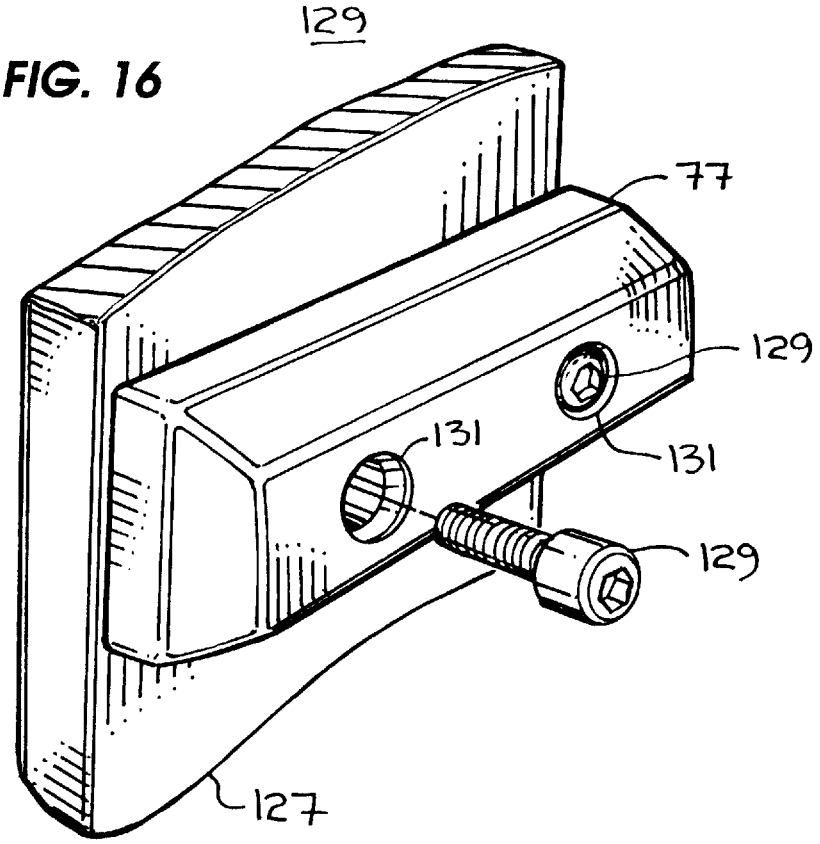
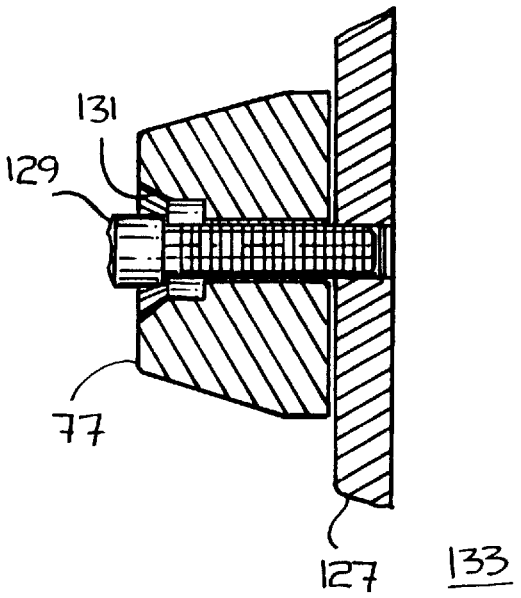
FIG. 17

FIG. 18
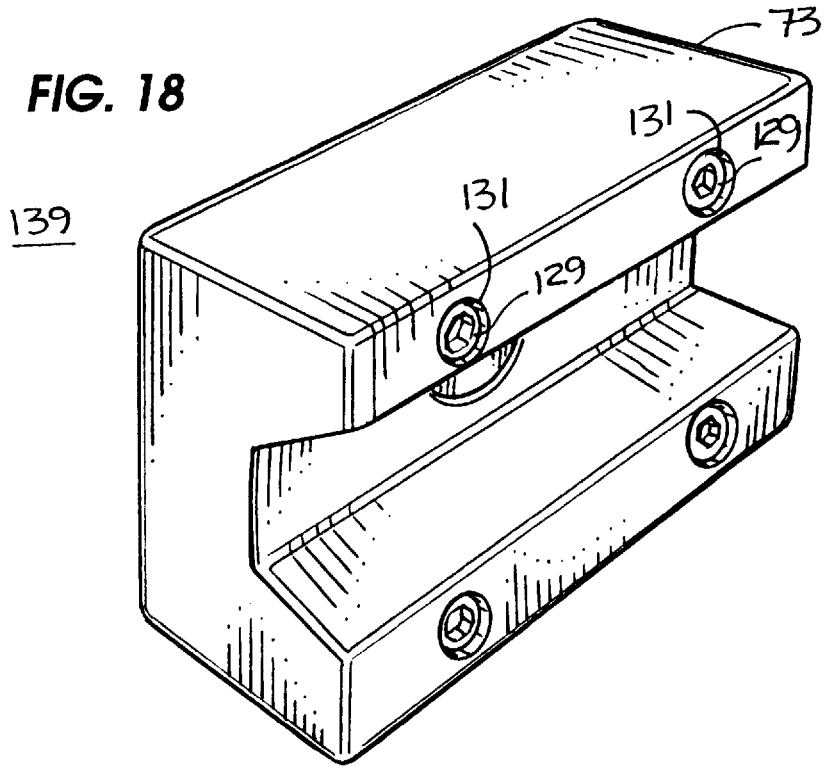
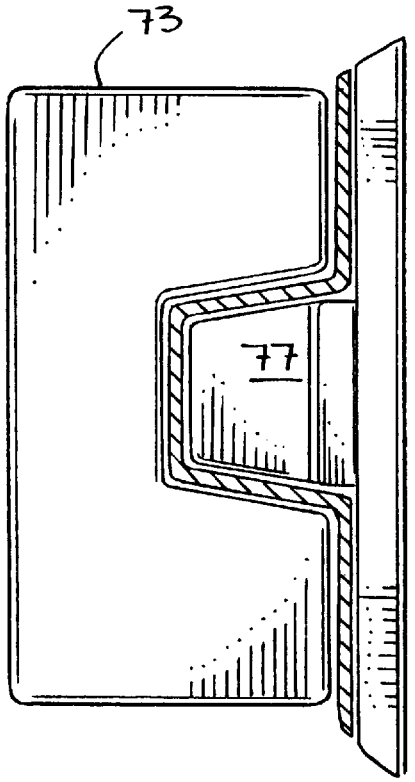
FIG. 19

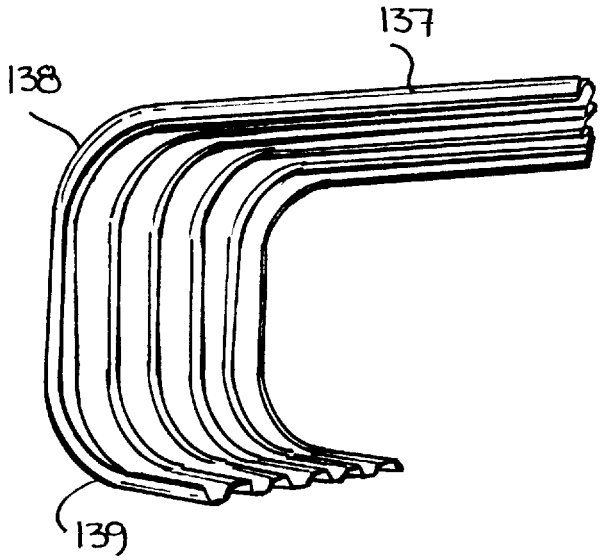
FIG. 20
FIG. 21
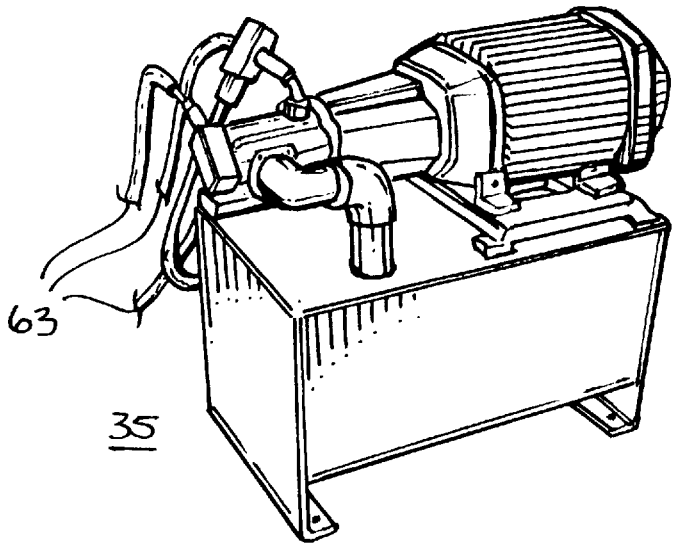

STRETCH BEND FORMING APPARATUS, METHOD AND PRODUCT FORMED THEREBY

BACKGROUND OF THE INVENTION

A. Field of the Invention

This invention relates to a method, apparatus and system for stretch bend forming of sheet stock to provide bent sheet stock.

More particularly, the present invention relates to stretch bend forming apparatus for stretch bend forming of simple or complex curves in sheet stock to provide bent sheet stock.

In a further and more specific aspect, the instant invention concerns a method and apparatus for stretch bend forming of corrugated or furrowed sheet stock to provide simple or complex curves in corrugated or furrowed sheet stock.

B. Prior Art

Prior art systems for forming bends in sheet stock include, for example, pan breaks and the like. While well adapted for providing abrupt bends in planar stock, these types of machines are not well adapted to providing large radius of curvature bends in planar stock. Additionally, these types of apparatus are poorly adapted to forming durable bent sheets of corrugated stock because they are not well adapted to accommodating the corrugations. When these types of bending devices are used to create bends in corrugated or furrowed stock, the corrugations or furrows are compressed, resulting in high localized stresses that in turn damage the finish of the sheet stock, result in decreased strength in the completed product and also provide poorer corrosion resistance due to the combination of damage to the finish and the effects of localized stresses and stretching of the material.

Corrugated or furrowed sheets of material are useful because the rigidity of sheets of material is improved by the presence of the corrugations or furrows. Resistance to bending perpendicular to the corrugations or furrows is also improved. Additionally, the ability to resist compressive forces directed along the length of the furrows or corrugations is also increased. All of these improvements are provided with little increased weight and result in less material being required for a specific application. This, in turn, reduces materials costs and also reduces the weight of the completed item. Examples of corrugated materials finding application in construction include aluminum and aluminum alloys and also iron and steel sheet materials. When iron sheets are employed for construction they are often zinc plated or galvanized. It is important in those cases to maintain the integrity of the galvanizing layer in order to preserve the desirable benefit of corrosion resistance. Dislocations introduced by bending and/or stretching of the sheet stock also tend to reduce corrosion resistance.

Bend forming devices adapted to handling of corrugated or furrowed sheet stock are able to provide large radius of curvature bends but do so in a way that results in substantial stretching of the sheet stock. This tends, once again, to result in high local stress of the sheet stock in the region of the bend. In addition to damage to the finish of the sheet stock resulting from stretching during the bending operation, the residual stresses tend to make the finish more susceptible to thermal cycling damage (e.g., flaking or peeling) and also tend to provide reduced corrosion resistance in the region of the bend as noted supra with respect to abrupt bends.

A feature common to such systems for bending sheet stock is a means that rigidly clamps the sheet stock during the bending process. This, in turn, promotes formation of localized stresses in the region that is bent by causing these areas to be stretched during the bending process. This also tends to increase stretching of the sheet stock during the bending process.

Accordingly, it is desirable, particularly with respect to corrugated or furrowed sheet stock that is to be bent, to provide a method and apparatus for reducing localized stresses and stretching in the region of the bend. Such apparatus and method result in reduced damage to the finish of the bent stock and also reduce the residual stresses and stretching of the corrugated or furrowed sheet stock in the region of the bend.

Further, the situations in which corrugated or furrowed sheet stock are bent are situations in which the increased strength and reduced weight of the corrugated material are desired. Especially when an optimal product design requires complex bending, it is desirable to preserve the beneficial properties of the corrugated material that led it to be selected for the intended application for which it is being prepared.

Accordingly, it is desirable to provide apparatus and methods for bending of corrugated or furrowed materials that result in reductions in the residual stresses. However, this alone is not necessarily sufficient because it is desirable to be able to preserve the finish of the sheet stock and also to reduce stretching (and risk of tearing or rupturing) of the corrugated or furrowed stock to the extent possible, while still providing the bends needed to complete the product or structure.

In order to combat these varied problems, some form of bending device is needed that provides all or many of these advantages even in the context of bending corrugated or furrowed materials. It is strongly desirable to maintain these advantages even when complex bending operations are required.

While the various mentioned prior art devices function as apparatus for shaping sheet stock, certain inherent deficiencies preclude adequate, satisfactory performance of the purpose of providing bends in corrugated or furrowed sheet stock without compromise of surface finish, without undue stretching and the resultant localized stress and also without undue compromise of the corrosion resistance properties of the material after it has been formed into the desired shape.

It would be highly advantageous, therefore, to remedy the foregoing and other deficiencies inherent in the prior art.

Accordingly, it is an object of the present invention to provide improvements in bend formation in sheet stock and in bent sheet stock.

Another object of the present invention is the provision of an improved method and apparatus for bending of sheet stock and especially for bending of corrugated or furrowed sheet stock.

An additional object of the instant invention is the provision of an improved method and apparatus for providing reduced localized residual stress and stretching of bent sheet stock.

Still a further additional object of the present invention is to provide an improved method, apparatus and system for the bending of sheet stock, together with reduced surface finish damage to the sheet stock when it is bent.

And another object of the present invention is to provide an improved method, apparatus and system for bending of corrugated or furrowed sheet stock to provide complex bend shapes therein.

Still another object of the present invention is the provision of a method, system and apparatus for bending of corrugated or furrowed sheet stock to provide improved corrosion resistance in the bent corrugated or furrowed sheet stock.

Yet another object of the instant invention is to provide a method, system and apparatus for bending of corrugated or furrowed sheet stock to provide bent corrugated or furrowed sheet stock having improved thermal cycling properties.

Yet still another object of the instant invention is the provision of a method, system and apparatus for providing improvements in bending of corrugated or furrowed sheet stock.

And a further object of the invention is to provide improved bent corrugated or furrowed sheet stock having reduced stretching, reduced damage to the surface finish and having improved thermal cycling and corrosion resistance properties.

Still a further object of the immediate invention is the provision of a method, apparatus and system for the formation of simple or complex bends in sheet stock and especially in corrugated or furrowed sheeting together with improved surface finish qualities.

And an additional object of the present invention is the provision of a stretch bend forming machine that is adapted to rapid and efficient set-up in order to accommodate different styles of sheet stock to be bent thereby.

Yet a further object of the invention is to provide a new system and method for stretch bend forming of corrugated or furrowed sheeting.

And still a further object of the invention is the provision of method and apparatus, according to the foregoing, which is intended to allow the formation of complex curves in corrugated or furrowed sheet stock together with improved surface finish, reduced material stretching, reduced internal stress, improved thermal cycling properties and improved corrosion resistance.

SUMMARY OF THE INVENTION

Briefly, to achieve the desired objects of the instant invention in accordance with a first preferred embodiment thereof, provided is a method and an apparatus for stretch bend forming of sheet stock and sheet stock bent by the method or apparatus. In a first preferred embodiment of the instant invention, a method for stretch bend forming of sheet stock is described. The method includes steps of clamping a first portion of the sheet stock in a first clamp and clamping a second portion of the sheet stock in a second clamp, with the first and second clamps in a first position.

The method also includes a step of moving a mandrel a first distance in a first direction to bring the mandrel into contact with a third portion of the sheet stock. The third portion of the sheet stock is disposed between the first and second portions of the sheet stock. The method also includes a step of moving the mandrel a second distance in the first direction to bend the third portion of the sheet stock.

The method for stretch bend forming of sheet stock wherein the steps of moving a mandrel a first distance and moving the mandrel a second distance desirably but not essentially includes a step of moving a mandrel having removable portions disposed on a bearing face thereof. The removable portions include wales adapted to mate to corrugations in the sheet stock. The mandrel is moved a first distance in a first direction to bring the mandrel into contact with a third portion of the corrugated sheet stock with the wales positioned in the corrugations in the corrugated sheet stock. The third portion of the corrugated sheet stock is disposed between the first and second portions. The method also includes a step of moving the mandrel a second distance in the first direction to bend the third portion of the corrugated sheet stock.

The method for stretch bend forming of sheet stock desirably but not essentially further comprises a step of relaxing the first and second clamps to provide controlled slippage of the first and second portions of the sheet stock in the first and second clamps.

The method for stretch bend forming of sheet stock desirably but not essentially further comprises a step of moving the first and second clamps from the first position to a second position in coordination with the step of moving the mandrel a second distance in the first direction, wherein, when the first and second clamps are in the second position, the first and second clamps are closer together than when the first and second clamps are in the first position.

The method for stretch bend forming of sheet stock further desirably but not essentially includes the first fixed clamp including removable fixed die faces having wales disposed thereon. The wales are adapted to clamp the corrugated sheet stock. The second fixed clamp includes removable fixed die faces having wales disposed therein. The wales are adapted to clamp the corrugated sheet stock.

The method desirably but not essentially includes steps of aligning the sheet stock with the wales disposed on the first fixed clamp such that the wales are disposed within the corrugations, aligning the sheet stock with the wales disposed on the second fixed clamp such that the wales are disposed within the corrugations, and the steps of clamping a first portion and clamping a second portion include a step of clamping a first portion of corrugated sheet stock in a first clamp, wherein the first clamp includes a first fixed clamp and a first moveable clamp. The first moveable clamp also includes removable moveable die faces adapted to mesh with the wales disposed on the first fixed clamp.

The method also includes a step of clamping a second portion of the corrugated sheet stock in a second clamp. The second clamp includes a second fixed clamp and a second moveable clamp. The second moveable clamp includes removable moveable die faces adapted to mesh with the wales disposed on the second fixed clamp.

The method for stretch bend forming of sheet stock, wherein the steps of moving a mandrel a first distance and moving the mandrel a second distance desirably but not essentially includes a step of moving a mandrel having removable portions disposed on a bearing face thereof, where the removable portions include wales adapted to mate to corrugations in the sheet stock, a first distance in a first direction to bring the mandrel into contact with a third portion of the corrugated sheet stock with the wales positioned in the corrugations in the corrugated sheet stock. The third portion of the corrugated sheet stock is disposed between the first and second portions. The method also includes a step of moving the mandrel a second distance in the first direction to bend the third portion of the corrugated sheet stock.

The method for stretch bend forming of sheet stock further desirably but not essentially includes a step of moving the first and second clamps from the first position to a second position in coordination with the step of moving the mandrel a second distance in the first direction, wherein, when the first and second clamps are in the second position, the first and second clamps are closer together than when the first and second clamps are in the first position.

In a second preferred embodiment, the invention contemplates an apparatus for stretch bend forming of sheet stock.

An apparatus for stretch bend forming sheet stock desirably includes a first clamp. The first clamp has a first fixed face and a first moveable face. The first clamp is mounted on rotating bearings disposed adjacent either end of the first fixed clamp. The apparatus for stretch bend forming sheet stock desirably includes a second clamp. The second clamp has a second fixed face and a second moveable face. The second clamp is mounted on second rotating bearings disposed adjacent either end of the second fixed clamp. The apparatus for stretch bend forming sheet stock desirably includes a mandrel disposed between the first and second clamps. The mandrel includes a forward stop, a reverse stop and a motive mechanism for moving the mandrel between the forward and reverse stops.

The apparatus for stretch bend forming sheet stock desirably further includes first removable fixed die faces having wales disposed thereon. The wales are adapted to clamp the corrugated sheet stock. The first removable fixed die faces comprise a portion of the first fixed clamp. The apparatus for stretch bend forming sheet stock desirably further includes second removable fixed die faces having wales disposed therein. The wales are adapted to clamp the corrugated sheet stock. The second removable fixed die faces comprise a portion of the second fixed clamp. The apparatus for stretch bend forming sheet stock desirably further includes a first moveable clamp. The first moveable clamp includes removable moveable die faces adapted to mesh with the wales disposed on the first fixed clamp. The apparatus for stretch bend forming sheet stock desirably further includes a second moveable clamp. The second moveable clamp includes removable moveable die faces adapted to mesh with the wales disposed on the second fixed clamp.

The apparatus for stretch bend forming sheet stock desirably but not essentially further includes (i) first means for aligning the sheet stock with the wales disposed on the first fixed clamp such that the wales are disposed within the corrugations and (ii) second means for aligning the sheet stock with the wales disposed on the second fixed clamp such that the wales are disposed within the corrugations.

The apparatus for stretch bend forming sheet stock desirably further comprises (i) means for moving the mandrel a first distance in a first direction to bring the mandrel into contact with a third portion of the corrugated sheet stock, wherein the mandrel includes removable portions disposed on a bearing face thereof, the removable portions including wales adapted to mate to corrugations in the sheet stock with the wales positioned in the corrugations in the corrugated sheet stock, the third portion of the corrugated sheet stock disposed between the first and second portions of the corrugated sheet stock and (ii) means for moving the mandrel a second distance in the first direction to bend the third portion of the corrugated sheet stock.

The apparatus for stretch bend forming sheet stock desirably is configured such that the means for moving the mandrel a second distance and the forward stop are adjustable.

The apparatus for stretch bend forming sheet stock desirably is configurable such that the adjustable forward stop comprises a screw fixedly attached to a base plate of the mandrel, a stop nut threadedly engaged with the screw and a stop plate fixedly coupled to a support column of the stretch bend forming machine, the screw extending through a hole in the stop plate, the hole being of a diameter that will not admit the stop nut.

The apparatus for stretch bend forming sheet stock wherein the adjustable forward stop desirably but not essentially further comprises a removable collar adapted to be attached to the screw. The removable collar is of a diameter that will not permit the removable collar to pass through the hole.

In an apparatus for stretch bend forming sheet stock, a method for altering a degree of bending of the sheet stock. The apparatus includes a first clamp, the first clamp having a first fixed face and a first moveable face, the first clamp mounted on rotating bearings disposed adjacent either end of the first fixed clamp. The apparatus also includes a second clamp. The second clamp has a second fixed face and a second moveable face. The second clamp is mounted on second rotating bearings disposed adjacent either end of the second fixed clamp. The apparatus also includes a mandrel disposed between the first and second clamps, the mandrel including a forward stop, a reverse stop and a motive mechanism for moving the mandrel between the forward and reverse stops. The method includes steps of clamping a first portion of the sheet stock in the first clamp, clamping a second portion of the sheet stock in the second clamp, wherein the first and second clamps are in a first position, moving the mandrel a first distance in a first direction to bring the mandrel into contact with a third portion of the sheet stock, the third portion of the sheet stock disposed between the first and second portions of the sheet stock and moving the mandrel a second distance in the first direction to bend the third portion of the sheet stock.

The method for stretch bend forming of sheet stock desirably but not essentially includes a step of moving the first and second clamps from the first position to a second position in coordination with the step of moving the mandrel a second distance in the first direction, wherein, when the first and second clamps are in the second position, the first and second clamps are closer together than when the first and second clamps are in the first position.

When the apparatus further comprises a screw fixedly attached to a base plate of the mandrel, a stop nut threadedly engaged with the screw and a stop plate fixedly coupled to a support column of the stretch bend forming machine, the screw extending through a hole in the stop plate, the hole being of a diameter that will not admit the stop nut therethrough, the method includes a step of adjusting the stop nut to alter the second distance and thereby alter a bend angle of the stock when the stock is bent.

When the apparatus further comprises a plurality of removable collars adapted to be attached to the screw, each of the plurality of removable collars being of a diameter that will not permit the removable collar to pass through the hole, wherein each of the plurality of removable collars corresponds to a predetermined stopping distance and therefore a predetermined degree of bend, the method additionally comprises steps of (i) selecting a one of the plurality of removable collars adapted to be attached to the screw having a length corresponding to a predetermined second distance, (ii) installing the selected one on the screw and (iii) bending the sheet stock to a predetermined angle corresponding to the selected one.

The method for stretch bend forming of sheet stock desirably but not essentially further comprises a step of moving the first and second clamps from the first position to a second position in coordination with the step of moving the mandrel a second distance in the first direction, wherein, when the first and second clamps are in the second position, the first and second clamps are closer together than when the first and second clamps are in the first position.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 16 is an illustration providing an isometric view of an interchangeable die face for the clamping apparatus of FIG. 1 of the stretch bend forming machine in accordance with the teachings of the instant invention;

FIG. 17 is an illustration showing a side view, in section, of a portion of the interchangeable die face for the clamping apparatus of FIG. 1 of the stretch bend forming machine in accordance with the teachings of the instant invention; FIG. 18 is an illustration providing an isometric view of an interchangeable die face adapted to mate to the interchangeable die face of FIGS. 16 and 17 for the clamping apparatus of the stretch bend forming machine in accordance with the teachings of the instant invention;

FIG. 19 is an illustration showing a side view, in section, of the interchangeable die faces of FIGS. 16, 17 and 18, mated to each other for the clamping apparatus of the stretch bend forming machine in accordance with the teachings of the instant invention;

FIG. 20 is an illustration showing a piece of corrugated metal that has been stretch bend formed by the stretch bend forming machine in accordance with the teachings of the instant invention;

FIG. 21 is a more detailed illustration of the hydraulic impeller of FIG. 1 for the stretch bend forming machine in accordance with the teachings of the instant invention.

DETAILED DESCRIPTION OF THE PREFERRED EMBODIMENT

§ A. OVERVIEW OF THE STRETCH BEND FORMING MACHINE

Figure 1:
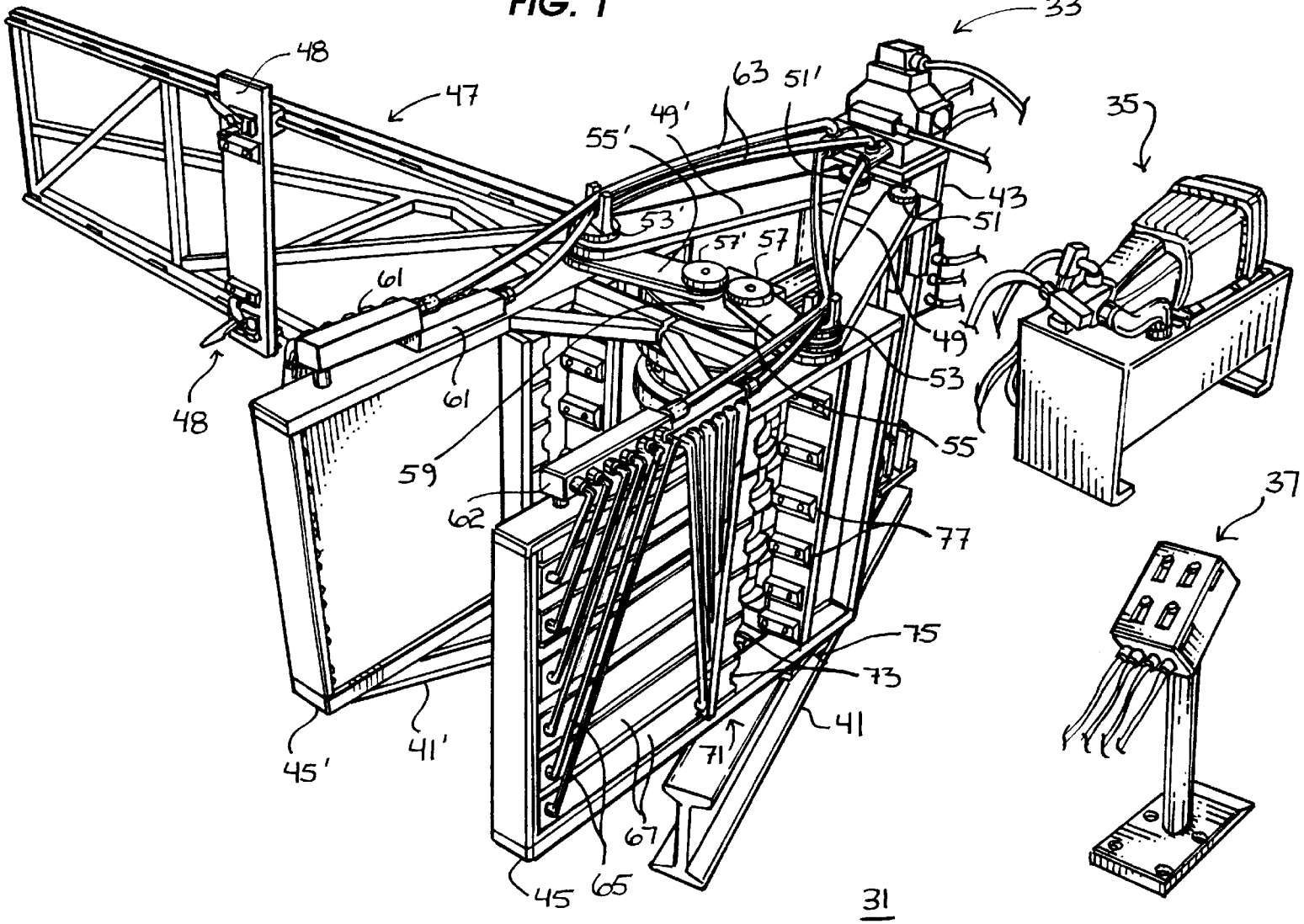
FIG. 1 is an illustration of an elevated isometric view, sketched in a partial cutaway view, of a stretch bend forming machine in accordance with the teachings of the instant invention.

Turning now to the drawings, in which like reference characters indicate corresponding elements throughout the several views, attention is first directed to FIG. 1 which illustrates a stretch bend forming system, generally designated by the reference character 31, for stretch bend forming of sheet stock (not illustrated in FIG. 1) and particularly for stretch bend forming of corrugated or furrowed sheet stock in accordance with the teachings of the instant invention.

Stretch bend forming system 31 includes a stretch bend forming machine 33, a hydraulic power source 35 and a control panel 37. The stretch bend forming machine 33 is shown in partial cutaway view in FIG. 1 to facilitate viewing of internal components and their interrelationships. For example, a boom 47 for holding and/or feeding stock is only illustrated as being on one side of the stretch bend forming machine 33; in operational stretch bend forming machines 33, a second boom 47 disposed symmetrically on the other side of the stretch bend forming machine 33 is strongly desirable or necessary for handling stock to be bent and after bending.

The stretch bend forming machine 33 includes basal members 41 and 41'. The basal members 41 and 41' support hydraulic clamp panels 45 and 45' and the basal members 41 and 41' also do so in a way that does not interfere with smooth motion of the clamp panels 45 and 45' during the operation of the stretch bend forming machine 33, as will be discussed in more detail with reference to FIGS. 2 and 6 through 9 (§§ C and D), infra.

The stretch bend forming machine 33 also includes a support column 43 fixedly mounted to the basal members 41 and 41', collectively providing rigid and rugged support for the booms 47, the clamp panels 45 and 45' and for a mandrel 59, visible in the central portion of the view of the stretch bend forming machine 33 provided in FIG. 1. Operation of the mandrel 59 in coordination with other elements of the stretch bend forming machine 33 is discussed in detail with reference to FIGS. 3 through 5, infra, and is illustrated in detail with reference to FIGS. 11 through 13, infra.

The stretch bend forming machine 33 further includes the clamp panels 45 and 45', which in turn each include a fixed clamp assembly 75 and a moveable clamp assembly 71. The moveable clamp assembly 71 moves towards or away from the fixed clamp assembly 75 in response to hydraulic power from the hydraulic power source 35 under the control of the operator via the control panel 37. Hydraulic power is delivered through hydraulic hoses 63, manifolds 61 and hydraulic feed lines 65 and is supplied to a moveable clamp assembly 71 via hydraulic pistons 67 mounted within the framework of each of the clamp panels 45 and 45'.

The moveable clamp assembly 71 includes multiple replaceable elements 73, while the fixed clamp assembly 75 includes multiple replaceable elements 77, each adapted to conform to the surface corrugations or furrowing of a particular type of sheet of sheet stock (not illustrated in FIG. 1) as is described in more detail with reference to FIGS. 16 through 19 (see § G), infra. The fixed clamp assembly 75 is fixedly mounted with respect to the clamp panels 45 or 45' and adjacent to the joints 53 and 53' while the moveable clamp assembly 71 is constrained to linear reciprocal motion within the plane of the clamp panel 45 or 45'.

Figure 2:
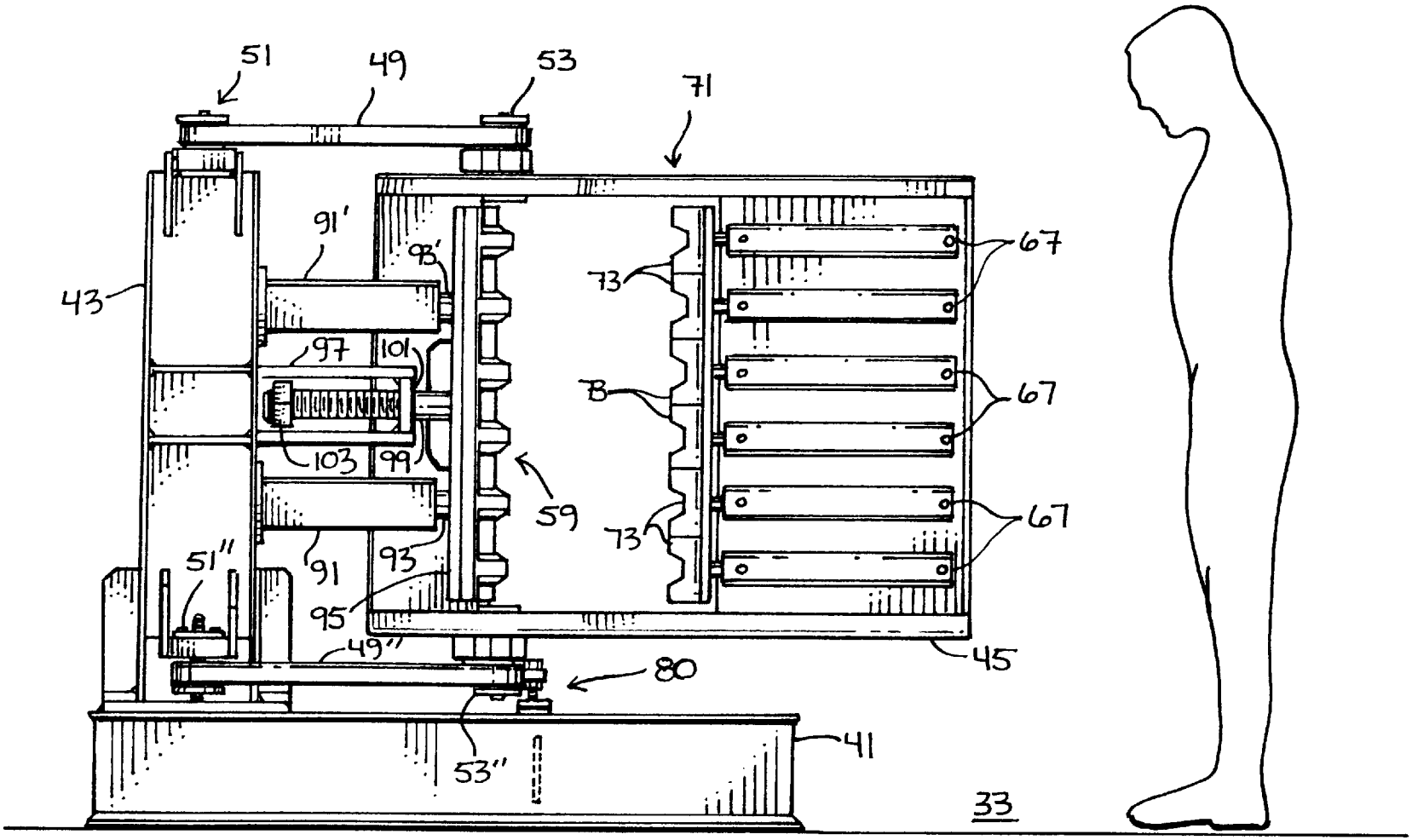
FIG. 2 is an illustration of a side view, sketched in a partial cutaway view, of the stretch bend forming machine showing the mandrel in relationship to the clamping apparatus in accordance with the teachings of the instant invention.

Now directing attention to FIG. 2, additional features of the stretch bend forming machine 33 are illustrated in a side view, sketched in a partial cutaway view, of the stretch bend forming machine 33 in accordance with the teachings of the instant invention. The view provided in FIG. 2 includes only a portion of one of the clamp panels 45 and 45' for ease of understanding and clarity of illustration. The clamp panel 45 is shown having upper joints 51 and 53 and also including lower joints 51" and 53". Upper coupling rod 49 and lower coupling rod 49" allow articulation of upper and lower joints 51, 53 and 51", 53" to permit clamping panel 45 to exhibit that range of motion required in order to stretch bend form suitable corrugated or furrowed sheet stock.

The mandrel 59 is shown to be attached by the mandrel base plate 95 to the pistons 93 and 93' of the hydraulic cylinders 91 and 91', respectively. The hydraulic cylinders 91 and 91' are in turn fixedly attached to the support column 43, allowing the mandrel 59 to be forced away from or to be withdrawn towards the support column 43 by means of hydraulic power from hydraulic power source 35 in response to signals from the operator input through control panel 37 and delivered via hydraulic lines 63.

Also illustrated in FIG. 2 is a stop assembly including a threaded rod 99 fixedly attached to the mandrel base plate 95 at a first end and having an adjustable stop nut 103 threadedly engaged thereto. A frame 97 is fixedly attached to the support column 43 at a first end and includes a stop plate 101 fixedly attached to a distal end thereof. The stop plate 101 includes an opening (not shown in FIG. 2) through which the threaded rod 99 readily passes but which cannot accommodate passage of the stop nut 103.

Accordingly, the end of the travel of the mandrel 59 in a first direction, away from the support column 43, in response to hydraulic power supplied by hydraulic cylinders 91 and 91', is determined when the mandrel 59 has traveled a predetermined distance in the first direction such that the stop nut 103 encounters the stop plate 101. The other end of the travel of the mandrel 59 in a second direction, towards the support column 43, is defined by the end of travel of the pistons 93 and 93' towards the support column 43. As will be seen from consideration of FIG. 15 and associated text (see § F), other and easily adjustable means for defining the end of travel of the mandrel 59 are intended to be included in the scope of the instant invention.

Also shown in FIG. 2 is a bearing assembly 80 moveably coupling the basal members 41 to the clamping assemblies 45 and 45' via a lower joint 53". The bearing assemblies 80 are designed to allow free motion over a limited range in two dimensions. The bearing assemblies 80 are discussed in more detail with respect to FIGS. 6 and 7, infra.

§ B. OPERATION OF THE STRETCH BEND FORMING MACHINE

Figure 3:
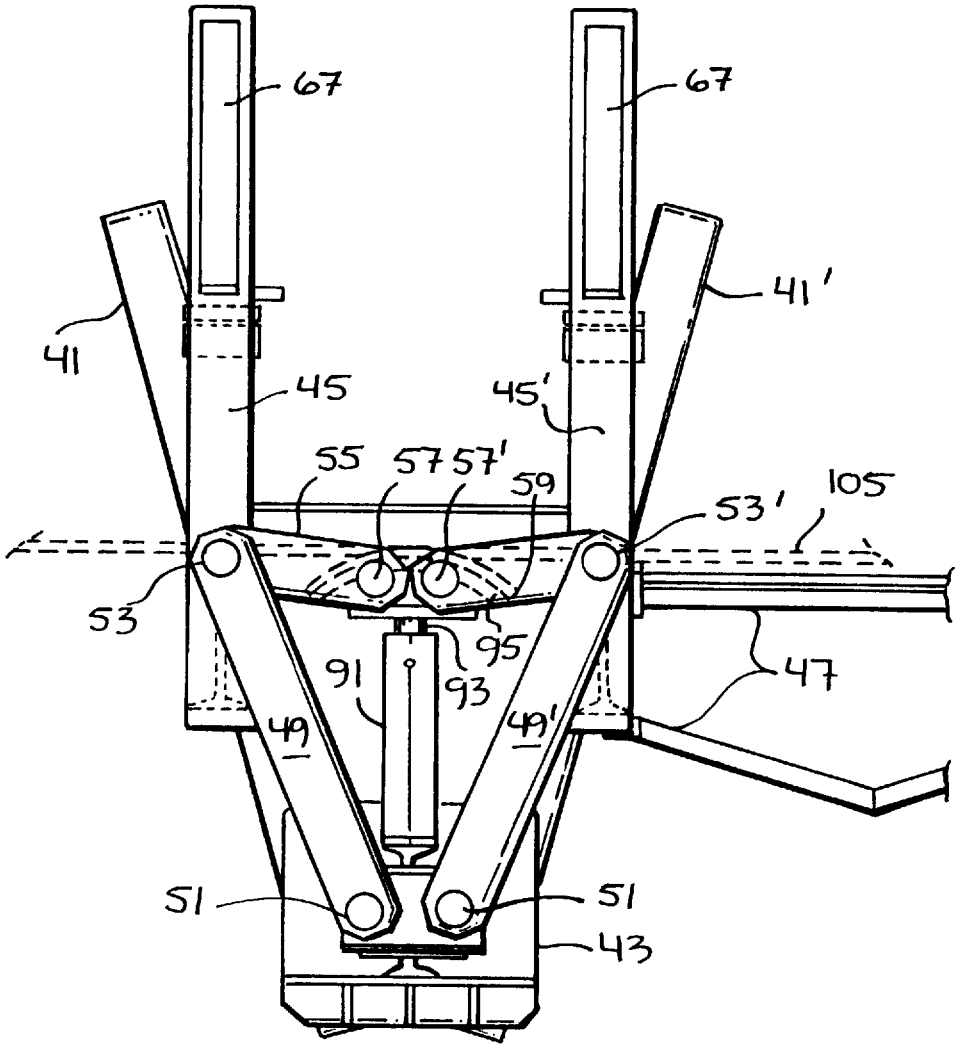
FIG. 3 is an illustration of a plan view, sketched in a partial cutaway view, of the stretch bend forming machine in a first position in accordance with the teachings of the instant invention.
Figure 4:
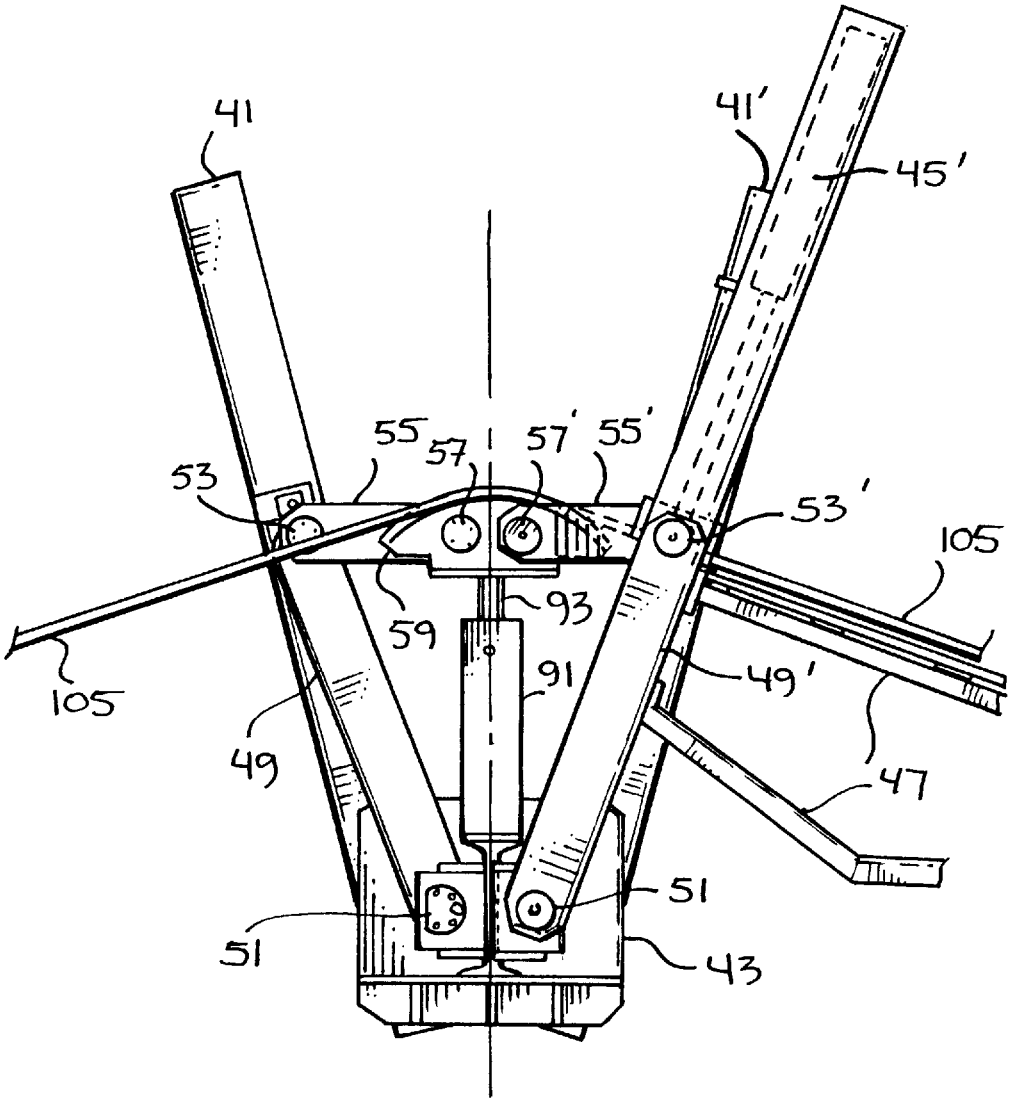
FIG. 4 is an illustration of a plan view in partial cutaway of the stretch bend forming machine in a second position in accordance with the teachings of the instant invention.
Figure 5:
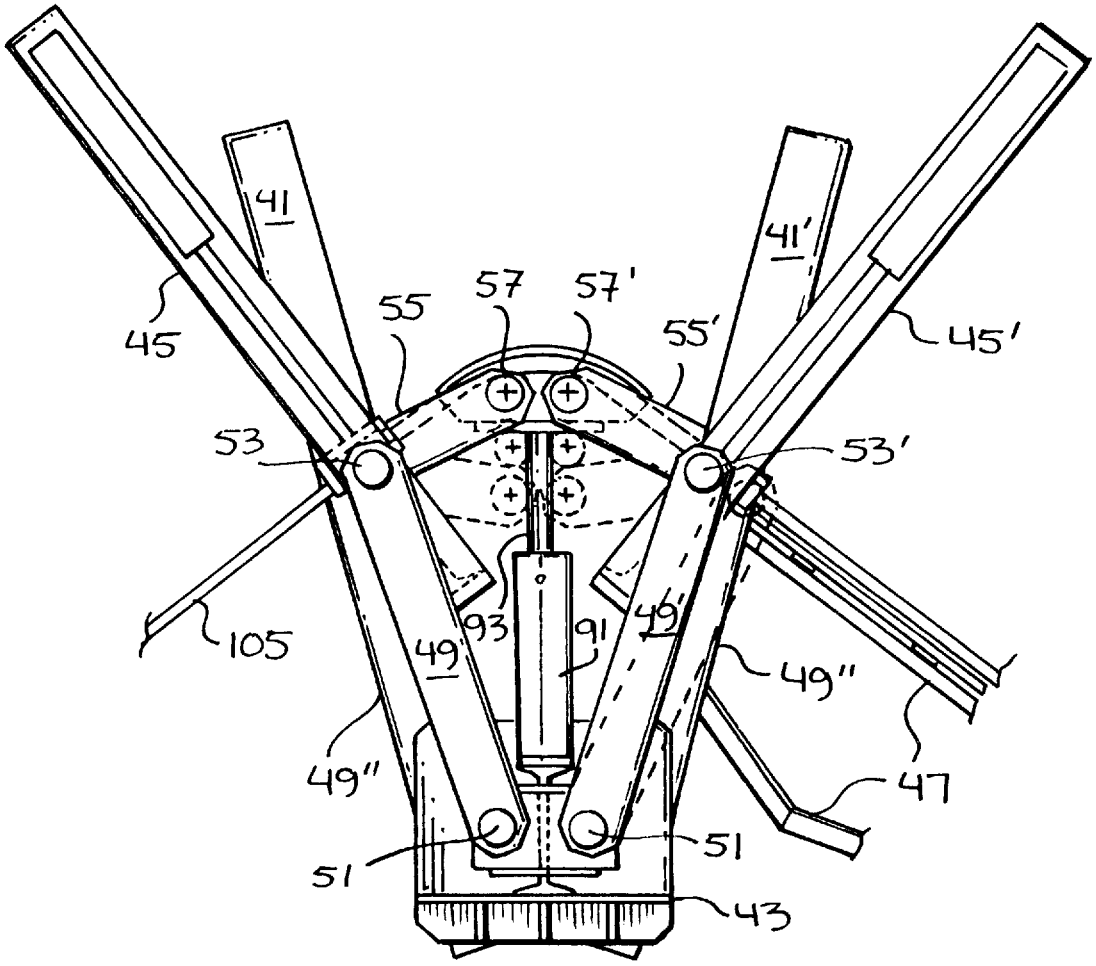
FIG. 5 is an illustration of a plan view, sketched in a partial cutaway view, of the stretch bend forming machine in a third position in accordance with the teachings of the instant invention, including a piece of metal being stretch bend formed.

FIGS. 3 through 5 illustrate relative motions of the clamping assemblies 45 and 45', the mandrel 59 and a sheet of stock during a cycle of bending by the stretch bend forming machine 33.

With reference now to FIG. 3, a plan view, sketched in a partial cutaway view, is provided of the stretch bend forming machine 33 in a first position in accordance with the teachings of the instant invention. In the first position, the piece of sheet stock 105 to be bent is loaded into position and is clamped by clamping guides 48 (see FIG. 1) attached to the booms 47. The clamping assemblies 45 and 45' are operated to secure the piece of sheet stock 105 to be bent by operation of hydraulic cylinders 67, forcing the moveable clamp assemblies 71 against the piece of sheet stock 105 and clamping the piece of sheet stock 105 against the fixed clamping assemblies 75. Following the clamping of the piece of sheet stock 105 to be bent by the clamping assemblies 45 and 45', the mandrel 59 is moved forward by action of the pistons 93 within the hydraulic cylinders 91. The mandrel 59 begins to contact and to bend the piece of sheet stock 105 as is depicted by the illustration contained in FIG. 4, infra.

Directing attention now to FIG. 4, an illustration is provided showing a plan view, sketched in a partial cutaway view, of the stretch bend forming machine 33 in a second position in accordance with the teachings of the instant invention. In FIG. 4, the mandrel 59 is illustrated as being directly between the center of the joints 53 and 53'. In this position, the coupling rods 55 and 55' are in line with each other, and the joints 53 and 53' are as far apart as the coupling rods 49, 49', 55 and 55' collectively permit them to get.

Turning now to FIG. 5, an illustration showing a plan view, sketched in a partial cutaway view, of the stretch bend forming machine 33 in a third position is provided in accordance with the teachings of the instant invention, including a piece of metal being stretch bend formed. In the positions illustrated in FIG. 5, the piece of stock 105 to be bent is shown in the final position (solid line, corresponding to completion of the bend) and two positions intermediate between that and the position of FIG. 4 of the mandrel 59, the coupling rods 55 and 55' and the joints 57 and 57' are shown in dotted line. When the mandrel 59 begins the over-the-center portion of the travel, the coupling rods 55, 55', 49 and 49' cooperate in such a way as to reduce the distance between the joints 53 and 53', which are located (see FIGS. 1 and 2, § A, supra) immediately above the place where the moveable clamp assemblies 71 meet the fixed clamp assemblies 75 to clamp the piece of sheet stock to be bent.

The inventors have discovered that a desirable effect of this over-the-center motion is to reduce the stretching of the piece of sheet stock 105 as it is being bent by the combined action of the clamp assemblies 45 and 45' and the mandrel 59. The inventors have also discovered that this allows 6% less stretching of the bent sheet stock to be achieved relative to conventional apparatus and methods for bending of sheet stock and especially of corrugated or furrowed sheet stock.

§ C. THE BEARING ASSEMBLIES

Figure 6:
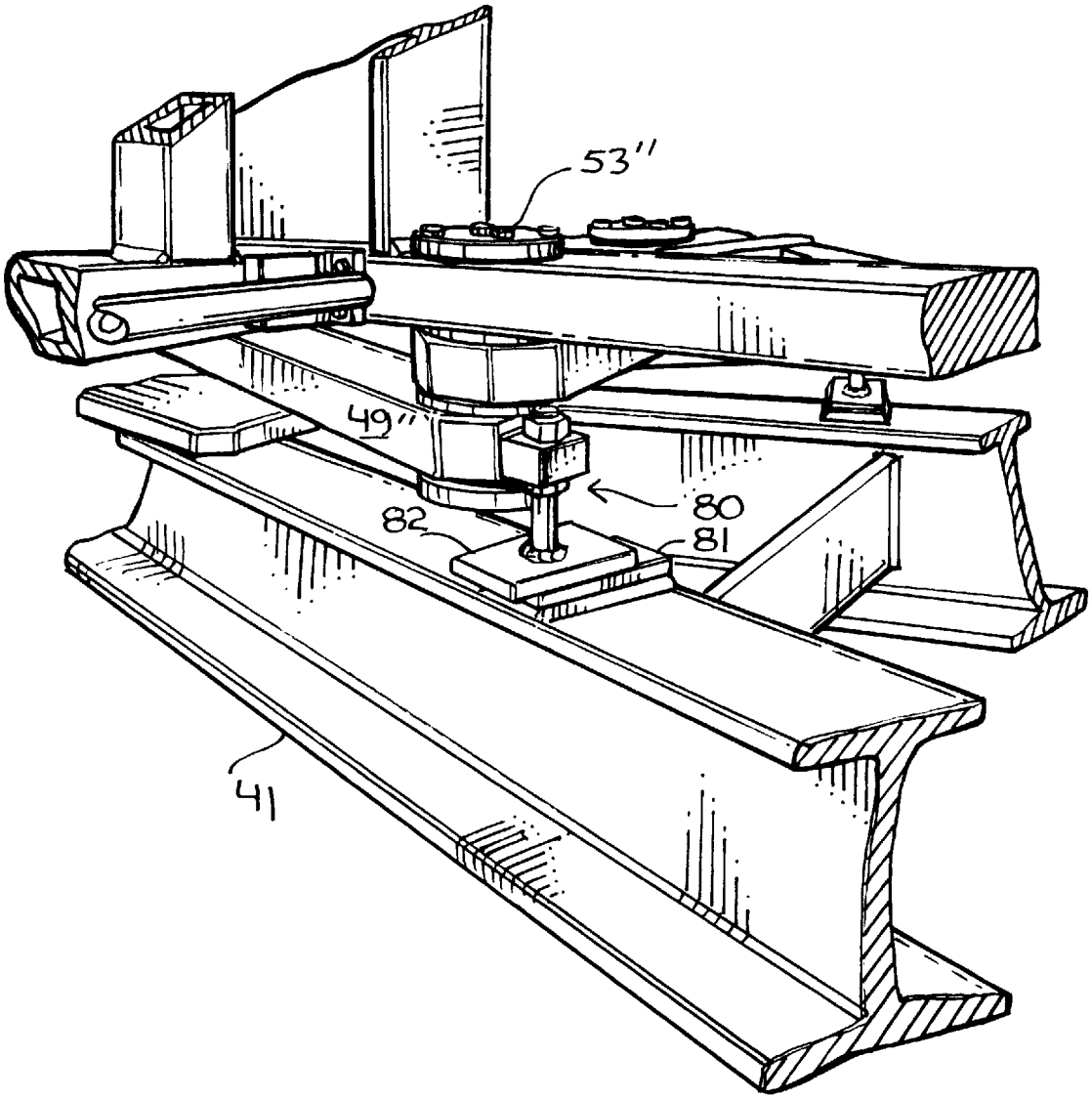
FIG. 6 is an illustration of an elevated isometric view of a portion of the stretch bend forming machine in accordance with the teachings of the instant invention, showing a moveable bearing in detail.
Figure 7:
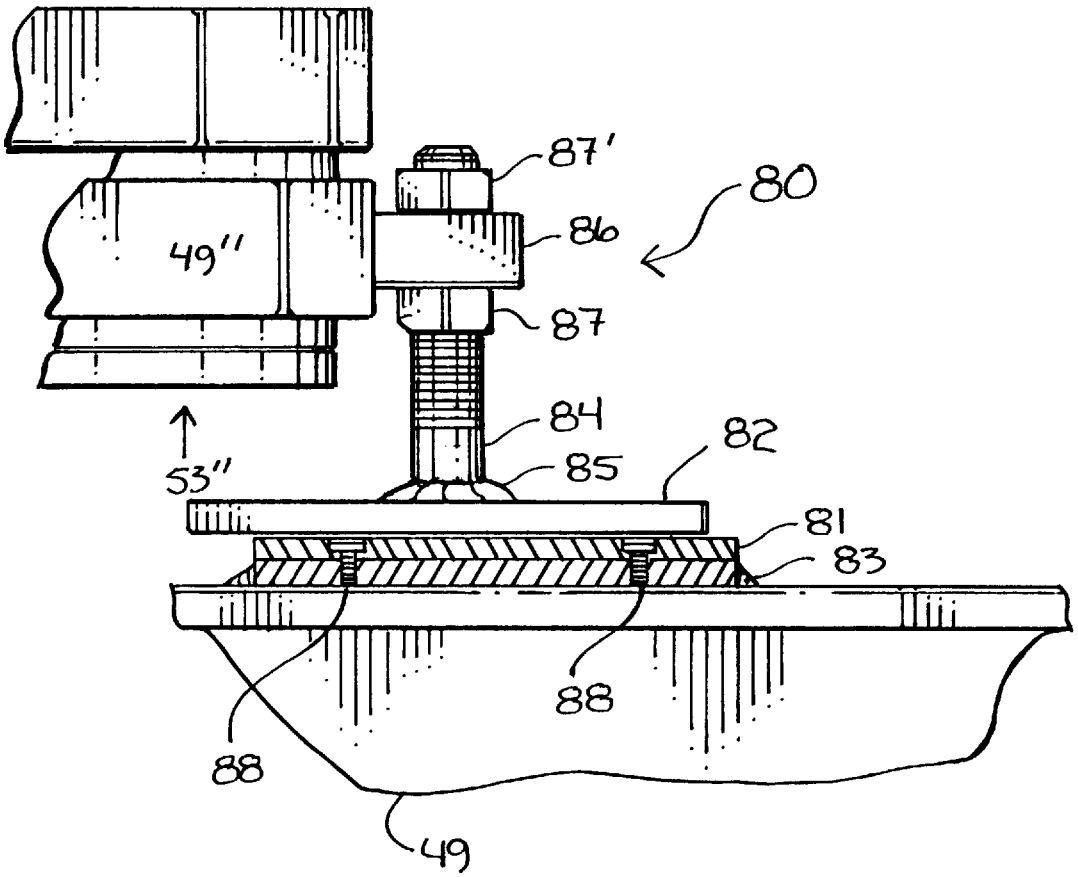
FIG. 7 is an illustration of a side view of a portion of the stretch bend forming machine in accordance with the teachings of the instant invention, showing a moveable bearing in detail.

FIGS. 6 and 7 illustrate the moveable bearings 80, showing how the moveable bearings 80 allow the clamping assemblies 45 and 45' to move freely in two dimensions relative to the basal members 41 and 41' and the support column 43.

Attention is now drawn to FIG. 6, which provides an illustration of an elevated isometric view of a portion of the stretch bend forming machine 33 in accordance with the teachings of the instant invention and showing a moveable bearing 80 in detail. The moveable bearing 80 comprises a first bearing surface 81 affixed to the basal member 41 and a second bearing surface 82 affixed to the lower joint 53". A lubricant is applied to the juncture of the first bearing surface 81 and the second bearing surface 82.

While the moveable bearing 80 is illustrated as being directly attached to the lower coupling rod 49", it will be appreciated that what is desirable is that the moveable bearing 80 be located in the vicinity of the joint 53" and that the method of attachment illustrated is simply one of those that could usefully be employed to achieve the desired freedom of motion in two dimensions.

With reference now to FIG. 7, an illustration is provided of a side view of a portion of the stretch bend forming machine 33 in accordance with the teachings of the instant invention, showing a moveable bearing 80 in detail. The moveable bearing 80 is seen to include a removable plate 81 secured to a fixed plate 83 by means, in this example, of screws 88. The removable plate 81 is desirably a brass plate in order to minimize wear of the first bearing surface 81 and the second bearing surface 82.

In the example illustrated in FIG. 7, the second bearing surface 82 is shown as being secured via a weld 85 to the threaded rod 84. The threaded rod 84 passes through a flange 86 and is adjustably secured thereto by means of nuts 87 and 87', allowing for height corrections, which may be required, for example, as the first bearing surface 81 wears.

§ D. THE FRAME ASSEMBLY

Figure 8:
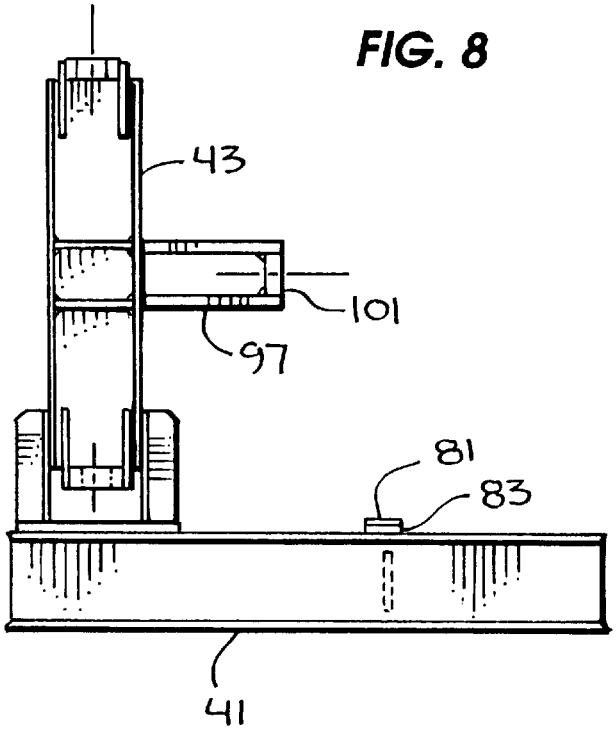
FIG. 8 is an illustration of a side view, in section, of the back and base of the stretch bend forming machine in accordance with the teachings of the instant invention.
Figure 9:
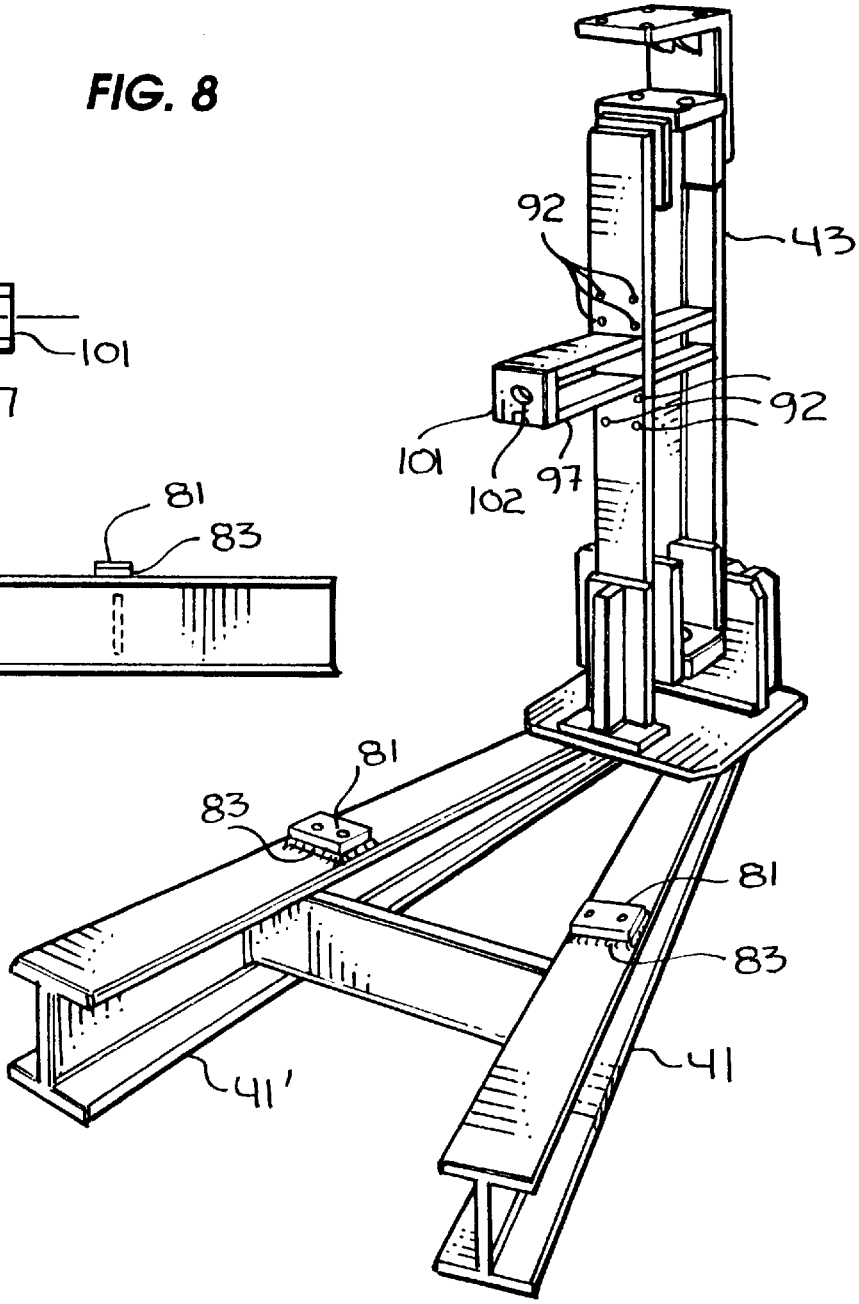
FIG. 9 is an illustration showing an elevated isometric view of the base and back of the stretch bend forming machine in accordance with the teachings of the instant invention.
Figure 10:
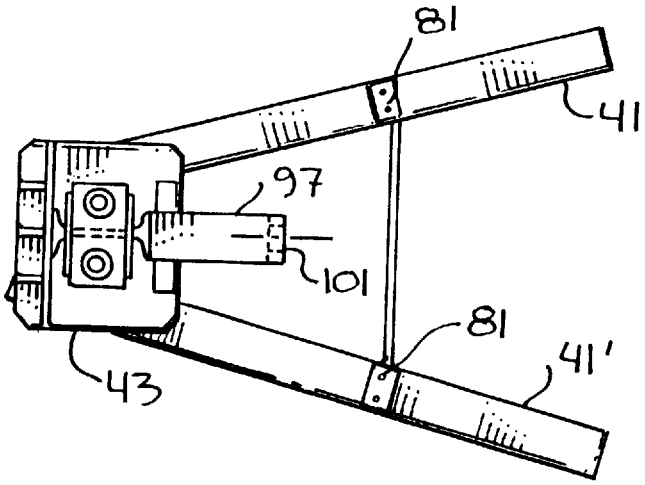
FIG. 10 is an illustration providing a plan view of the base and back of the stretch bend forming machine in accordance with the teachings of the instant invention.

Directing attention now to FIGS. 8–10, the relationships between several of the supporting components comprising the frame of the stretch bend forming machine 33 are illustrated.

Turning now to FIG. 8, an illustration of a side view, in section, of the support column 43 and the basal members 41 and 41' of the stretch bend forming machine 33 is provided in accordance with the teachings of the instant invention. FIG. 8 illustrates the relationship between support member 43, basal members 41 and 41' and the frame 97 and the stop plate 101. The stop screw 99 on the mandrel 59 (not shown in FIG. 8) readily traverses the stop plate 101 as illustrated by the centerline thereto and travel within the stop plate support 101.

Directing attention now to FIG. 9, an illustration showing an elevated isometric view of the basal members 41 and 41' and the support column 43 of the stretch bend forming machine 33 is provided in accordance with the teachings of the instant invention. The stop plate 101 having an opening 102 disposed therein captures the stop nut 103 (not illustrated in FIG. 9) that is threadedly engaged with the threaded rod 99 (not shown in FIG. 9) coupled to the mandrel 59 (not illustrated in FIG. 9), limiting the motion of the mandrel 59 away from the support column 43. A series of holes 92 allow mounting of the hydraulic cylinders 91 and 91' (not shown in FIG. 9) to the support column 43.

With reference now to FIG. 10, an illustration providing a plan view of the basal members 41 and 41' and the support column 43 of the stretch bend forming machine 33 is provided in accordance with the teachings of the instant invention. FIGS. 8, 9 and 10 exemplify the interrelationship of the support column 43, the mandrel 59, the hydraulic cylinders 91 and 91', the stop plate 101 and the stop support 101 in a preferred embodiment of the stretch bend forming machine 33 of the instant invention.

§ E. THE MANDREL

Figure 11:
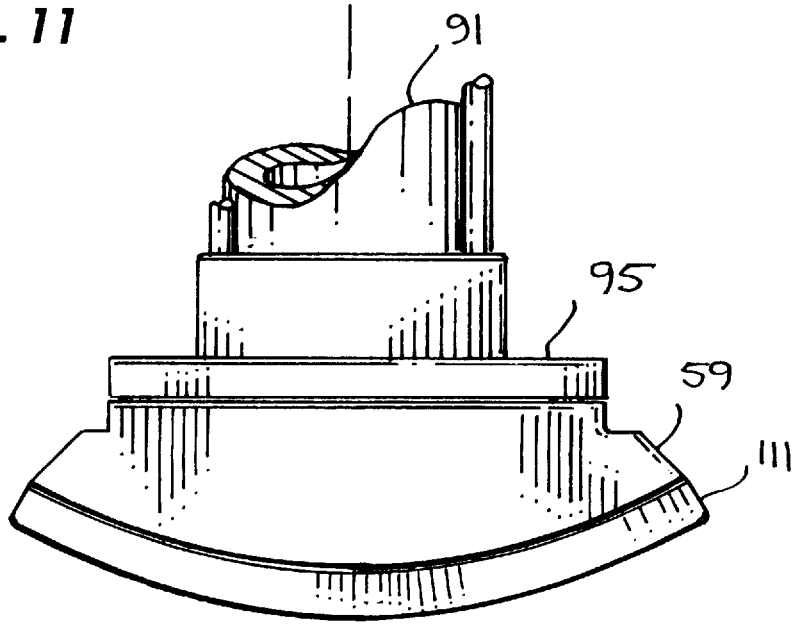
FIG. 11 is an illustration showing a side view of the mandrel of the stretch bend forming machine in accordance with the teachings of the instant invention.
Figure 12:
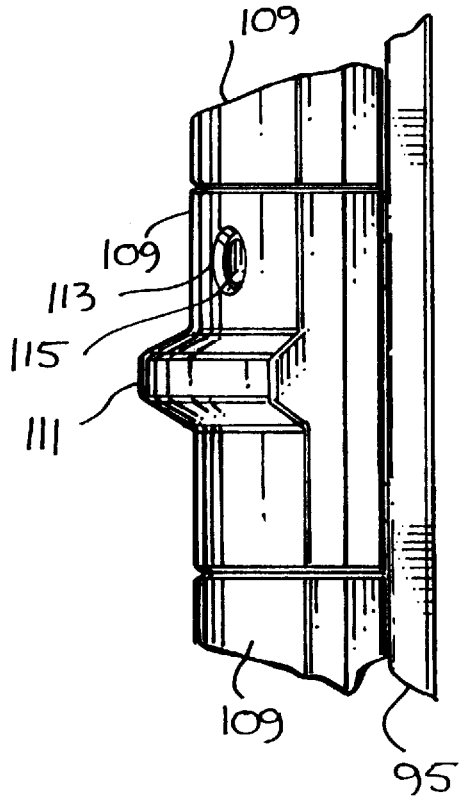
FIG. 12 is an illustration providing a side view of a limited portion of the mandrel of the stretch bend forming machine in accordance with the teachings of the present invention.
Figure 13:
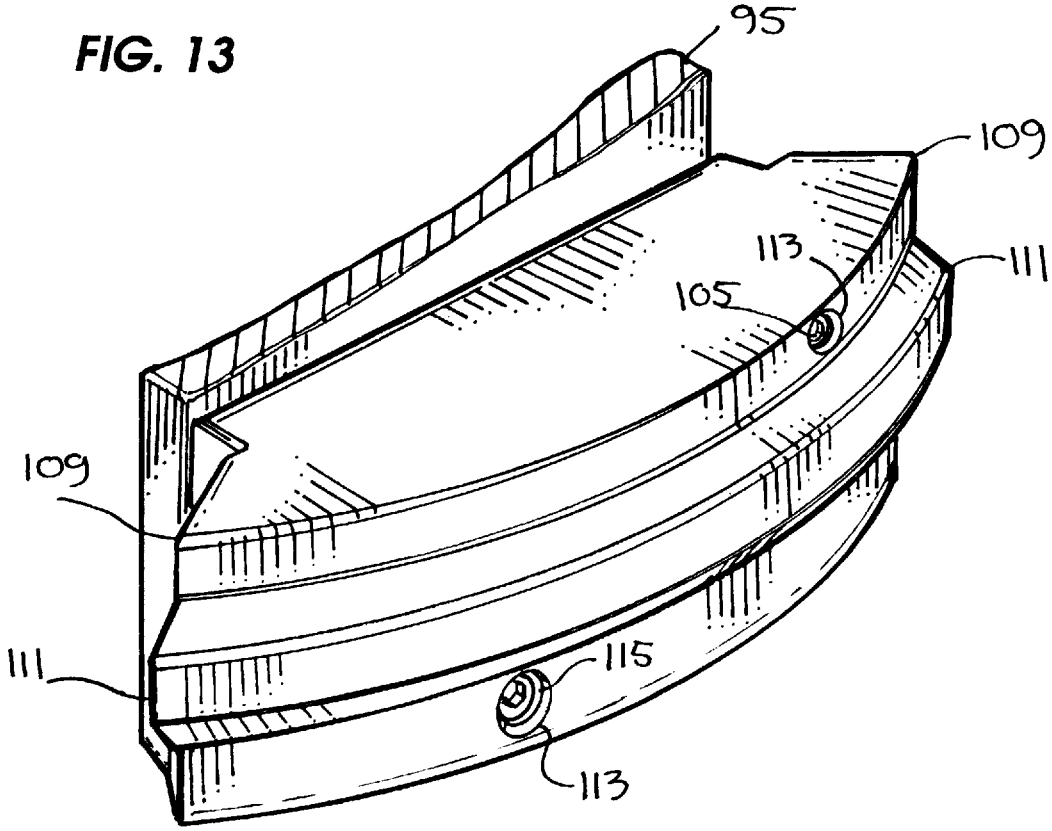
FIG. 13 is an illustration showing an elevated isometric view of a portion of the mandrel of the stretch bend forming machine in accordance with the teachings of the instant invention.

Directing attention now to FIGS. 11 through 13, the mandrel 59 is examined in various differing views. FIGS. 11 through 13 illustrate attachment of the mandrel 59 to the hydraulic pistons 91 and 91' and also show how elements 109 comprising the mandrel 59 are quickly and easily attached and detached from the base plate 95, facilitating set-up of the stretch bend forming machine 33 (see FIGS. 1 and 2) to accommodate various differing types of sheet stock to be bent.

Now with reference to FIG. 11, an illustration showing a side view of the mandrel 59 of the stretch bend forming machine 33 is provided in accordance with the teachings of the instant invention. The mandrel 59 includes a ridge or wale 111 adapted to accommodate the furrows or corrugations in the sheet stock to be bent by the stretch bend forming machine 33 (see FIGS. 1 and 2).

Drawing attention now to FIG. 12, an illustration providing a side view of a limited portion 107 of the mandrel 59 of the stretch bend forming machine 33 is shown in accordance with the teachings of the present invention. The limited portion 107 of the mandrel 59 shows that the mandrel 59 is comprised of a multiplicity of separate elements 109, each of which is coupled to the base plate 95 by screws 115 located below the surface of each of the multiplicity of the elements 109 in screw holes 113. The cap head screws 115 shown in FIG. 12 in the countersunk holes 113 allow interchangeability of the multiplicity of the elements 109 to provide mandrels 59 adapted to particular types of corrugated or furrowed sheet stock and also prevent the screws 115 from damaging the sheet stock during the bending operation.

Turning now to FIG. 13, an illustration showing an elevated isometric view of a portion 117 of the mandrel 59 of the stretch bend forming machine 33 is provided in accordance with the teachings of the instant invention. The portion 117 illustrates in more detail how the elements 109 fit together on the base plate 95 and are held there by the screws 115 in a fashion that aligns the ridges or wales 111 disposed on adjacent ones of the multiplicity of elements 109.

The illustrations of FIGS. 11 through 13 provide a mandrel 59 that is easily and quickly adapted to accommodate different types of corrugated sheet stock. The mandrel 59 may be adapted to varying widths of sheet stock by varying the number of elements in the multiplicity of elements 109 that comprise the mandrel 59. It will be appreciated by those of skill in the relevant arts that other types of mandrels 59 may also be usefully employed in the stretch bend forming machine 33.

§ F. THE MANDREL LOCOMOTION ASSEMBLY

Figure 14:
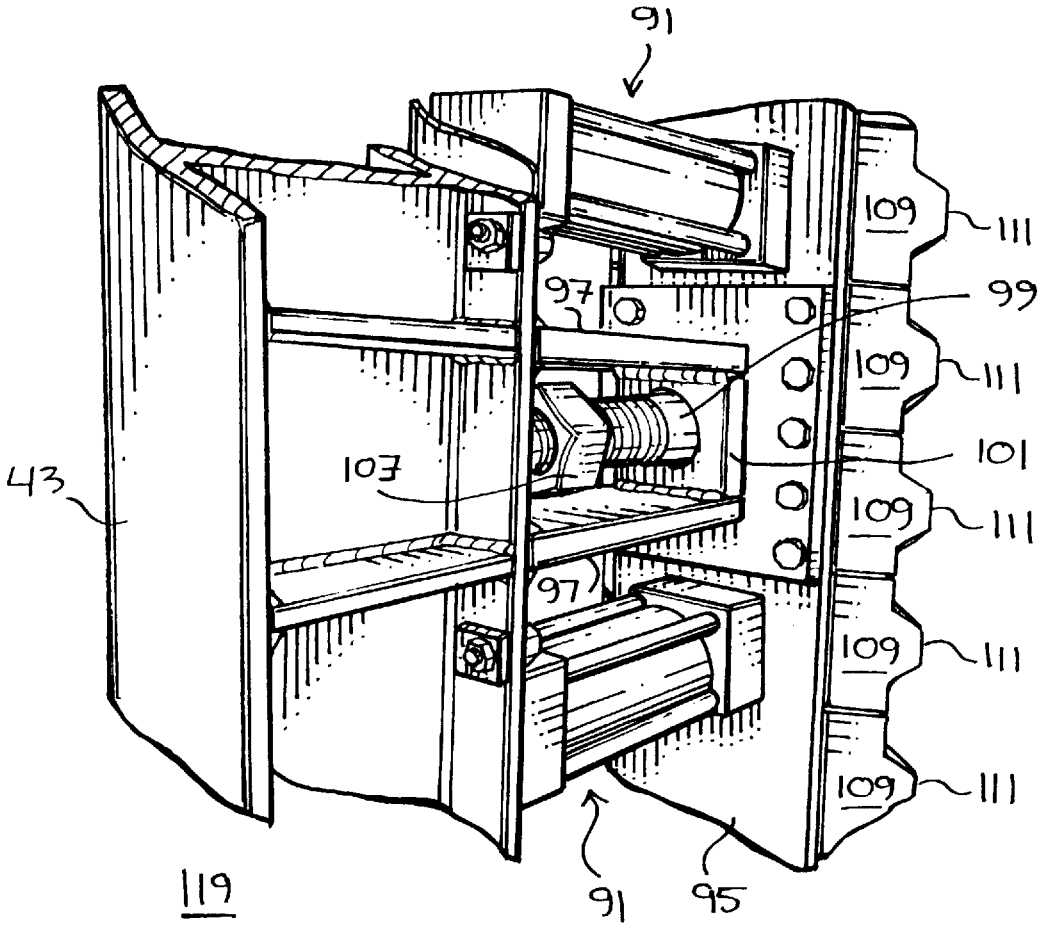
FIG. 14 is an illustration providing a rear isometric view of the basal portion of the mandrel of the stretch bend forming machine in accordance with the teachings of the instant invention.
Figure 15:
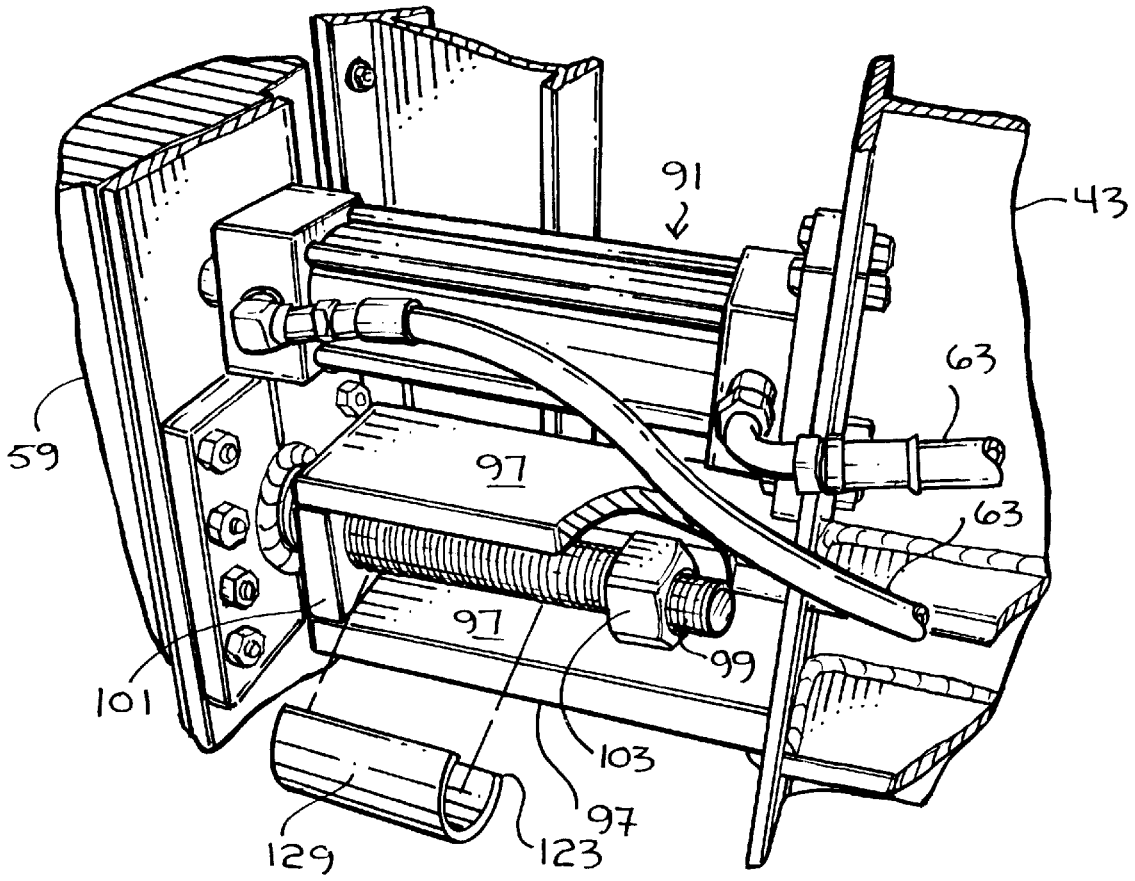
FIG. 15 is an illustration showing a side view of a portion of the basal segment of the mandrel of the stretch bend forming machine in accordance with the teachings of the instant invention, providing an example of a removable stop therefor.

Attention is now drawn to FIGS. 14 and 15, which provide details showing how the support column 43, the hydraulic cylinders 91 and 91, the stop screw 99 and the mandrel 59 are interrelated.

Directing attention now to FIG. 14, an illustration showing a rear isometric view of a basal portion 119 of the mandrel 59 of the stretch bend forming machine 33 is provided in accordance with the teachings of the instant invention. FIG. 14 also illustrates the attachment of the hydraulic cylinders 91 and 91' to both the mandrel base plate 95 and to the support column 43. The stop plate 101 is attached to the support column 43 by the stop support 101, forcing the mandrel 59 to stop when the stop nut 103 is forced against the stop plate 101 by the hydraulic cylinders 91 and 91'.

With reference now to FIG. 15, an illustration showing a side view of a portion 121 of the basal segment 119 of the mandrel 59 of the stretch bend forming machine 33 is shown in accordance with the teachings of the instant invention, providing an example of a removable stop 123 therefor. The removable stop 123 provides a rapid and efficient method for adjusting the maximum forward travel of the mandrel 59 to a predetermined amount without having to turn stop nut 103 in the confined space provided by the stop support 101. This, in turn, provides, among other things, a rapid and efficient method for adjusting the degree of bend that is provided by limiting the forward motion of the mandrel 59 when the mandrel 59 is bending the sheet stock.

§ G. THE INTERCHANGEABLE CLAMPING ASSEMBLIES

Attention is now drawn to FIGS. 16 through 19, illustrating details of construction of the die faces comprising the movable clamp assembly 71 and the fixed clamp assembly 75 of the clamping assemblies 45 and 45'.

Directing attention now to FIG. 16, an illustration providing an isometric view of a portion 125 of an interchangeable die face 77 for the clamping apparatus 45 and 45' of FIGS. 1 and 2 of the stretch bend forming machine 33 is provided in accordance with the teachings of the instant invention. The interchangeable die face 77 is attached to the base plate 127 by cap screws 129 extending through countersunk holes 131 in the interchangeable die face 77, facilitating repairs and/or set-up of the stretch bend forming machine 33 for readily accommodating differing types of corrugated stock.

With reference now to FIG. 17, an illustration showing a side view, in section, of a portion 133 of the interchangeable die face 75 for the clamping apparatus 45 and 45' of FIG. 1 of the stretch bend forming machine 33 is provided in accordance with the teachings of the instant invention. The screw 129 is shown partially inserted into the screw hole 131 and the screw 129 threadedly engages with the base plate 127. As with the multiplicity of elements 109 comprising the mandrel 59 (see FIGS. 11 through 13 and associated text, § E, supra), this arrangement allows different corrugations or widths of sheet stock to be quickly and easily accommodated by the stretch bend forming machine 33.

Directing attention now to FIG. 18, an illustration providing an isometric view of an interchangeable die face 73 adapted to mate to the interchangeable die face 77 of FIGS. 16 and 17 for the clamping apparatus 45 and 45' of the stretch bend forming machine 33 is provided in accordance with the teachings of the instant invention. The portion 135 illustrated in FIG. 18 is shown as being securable by cap screws 129 inserted through screw holes 131 in much the same fashion as the interchangeable die face 77 of FIGS. 16 and 17, supra.

Attention is now directed to FIG. 19, providing an illustration showing a side view, in section, of the interchangeable die faces 73 and 77 of FIGS. 16, 17 and 18, mated to each other for the clamping apparatus 45 and 45' of the stretch bend forming machine 33 in accordance with the teachings of the instant invention.

The arrangement illustrated in FIGS. 16 through 19 allows ready interchangeability of die faces 71 and 75 to accommodate differing widths of stock and different corrugations. It will be appreciated by those of skill in the relevant arts that other arrangements are possible.

§ H. THE PRODUCT

Turning now to FIG. 20, an illustration showing a piece of corrugated metal 137 that has been stretch bend formed by the stretch bend forming machine 33 of FIGS. 1 and 2 is provided in accordance with the teachings of the instant invention. The piece of corrugated metal 137 is shown as having been bent at a first bend 139 and also at a second bend 138, showing that the stretch bend forming machine 33 is capable of executing complex bends to provide the desired final form for the sheet stock 137.

It will be appreciated that the bent corrugated sheet stock 137 illustrated in FIG. 20 finds application in, among other things, the construction industry where the advantages of corrugated sheet stock, such as increased resistance to bending across the corrugations or furrows and increased supporting ability along the length of the corrugations, coupled with reduced overall weight, are now combined with an ability to shape the corrugated or furrowed stock. This is provided together with reduced stretching of the corrugated sheet stock, resulting in superior finish, corrosion resistance and also reduced vulnerability to thermal cycling of the bent corrugated sheet stock.

§ I. POWER AND CONTROL SYSTEM

With reference now to FIG. 21, a more detailed illustration of the hydraulic impeller 35 of FIG. 1 for the stretch bend forming machine 33 of FIG. 1 is provided in accordance with the teachings of the instant invention. The hydraulic impeller 35 provides hydraulic power to the clamps 45 and 45' and to the hydraulic cylinders 91 and 91' that move the mandrel 59 via the hydraulic lines 63.

Figure 22:
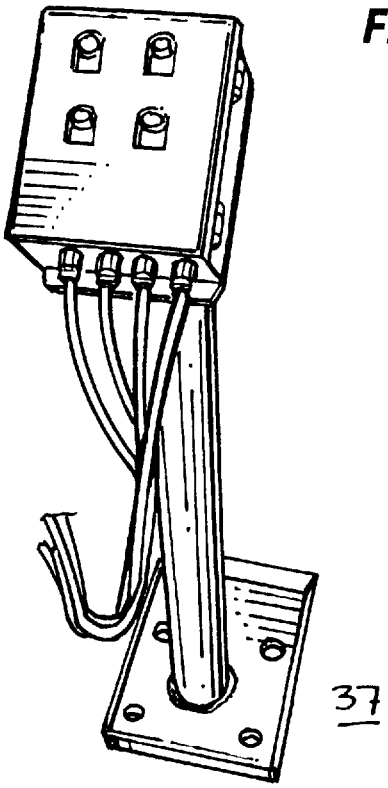
FIG. 22 is a more detailed illustration of a control panel for the hydraulic impeller for the stretch bend forming machine of FIG. 1 in accordance with the teachings of the instant invention.

Directing attention now to FIG. 22, a more detailed illustration of a control panel 37 for the hydraulic impeller 35 for the stretch bend forming machine 33 of FIG. 1 is provided in accordance with the teachings of the instant invention. The operator, via control panel 37, directs hydraulic pressure from the hydraulic impeller 35 in a sequence of steps including steps for operating the hydraulic clamp panels 45 and 45' via the manifolds 61 and the hydraulic lines 63.

Figure 23:
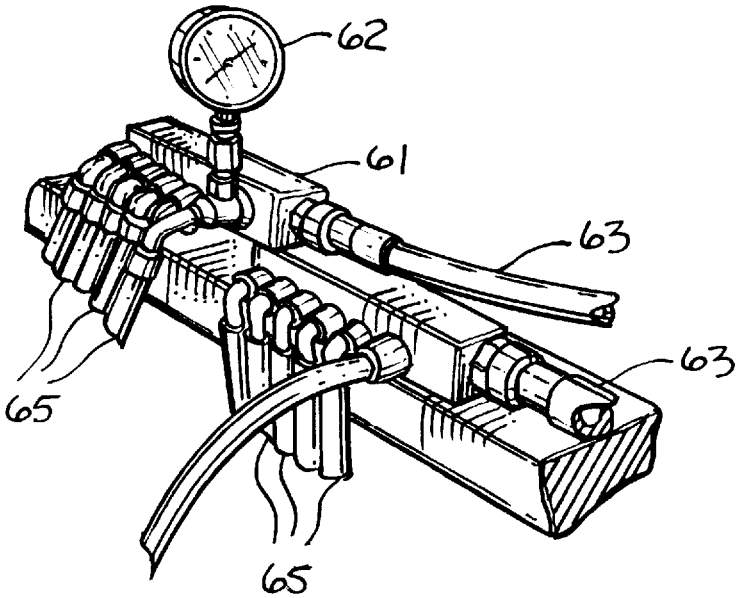
FIG. 23 is a more detailed illustration of a hydraulic manifold for the clamping apparatus of FIGS. 1 and 2 for the stretch bend forming machine in accordance with the teachings of the instant invention.

Turning now to FIG. 23, a more detailed illustration of a hydraulic manifold assembly 61 for the clamping apparatus of FIGS. 1 and 2 for the stretch bend forming machine 33 is provided in accordance with the teachings of the instant invention. The manifold assembly desirably but not essentially includes means for monitoring hydraulic fluid pressure such as the pressure meter 62.

§ J. CONCLUSION

It will be appreciated that many different types of corrugated material may be bent to desired shapes using the apparatus and methods of the instant invention. Additionally, it will be appreciated that the bent corrugated material retains the advantages for which corrugated sheet stock is desired. Further, the degree of bending may be controlled, the residual stress in the bent stock is reduced, the degree of stretching in the bent stock is reduced and the process results in a product having a superior finish when compared to prior art devices and practices.

The foregoing detailed description of the instant invention for the purposes of explanation have been particularly directed toward method and apparatus for stretch bend forming of sheet stock. It will be appreciated that the invention is equally useful in other embodiments and forms and that these are intended to be included in the scope of the present invention.

Various changes and modifications to the embodiment herein chosen for purposes of illustration will readily occur to those skilled in the art. For example, other arrangements for rapidly and efficiently altering the degree of bending are possible as may be desired for a specific application. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An apparatus for stretch bend forming sheet stock, said apparatus comprising:

a first clamp movable between a first position and a second position;

a second clamp spaced from the first clamp and movable between a first position and a second position, the first and second clamps for engaging and supporting a piece of sheet stock in one of the first and second positions thereof at spaced-apart points along a length of the sheet stock;

a mandrel mounted intermediate the first and second clamps for movement between a first position and a second position in opposition to the sheet stock intermediate the spaced-apart points, the first and second clamps each mounted with the mandrel for free movement in response to movement of the mandrel; and means for moving the mandrel between the first and second positions to engage the sheet stock intermediate the spaced-apart points in one of the first and second positions, the combined movement of the mandrel and the free movement of the first and second clamps cooperating together to bend the sheet stock in one of the first and second positions of the mandrel.

2. The apparatus of claim 1, wherein the first clamp further includes a pair of opposing faces movable between the first and second positions for engaging the sheet stock in one of the first and second positions.

3. The apparatus of claim 2, the sheet stock further including corrugations, wherein the pair of opposing faces of the first clamp each include wales to engage and mate with the corrugations of the sheet stock.

4. The apparatus of claim 1, wherein the second clamp further includes a pair of opposing faces movable between the first and second positions for engaging the sheet stock in one of the first and second positions.

5. The apparatus of claim 4, the sheet stock further including corrugations, wherein the pair of opposing faces of the second clamp each include wales to engage and mate with the corrugations of the sheet stock.

6. The apparatus of claim 1, the sheet stock further including corrugations, wherein the mandrel includes a face having wales to engage and mate with the corrugations of the sheet stock.

7. The apparatus of claim 1, further including:

means for aligning the sheet stock with the first clamp; and means for aligning the sheet stock with the second clamp.

8. The apparatus of claim 1, further including:

means for moving the mandrel a first distance toward one of the first and second positions to bring the mandrel into contact with the sheet stock; and means for moving the mandrel a second distance toward one of the first and second positions to bend the sheet stock.

9. The apparatus of claim 8, wherein the means for moving the mandrel a second distance is adjustable.

10. The apparatus of claim 8, wherein the means for moving the mandrel a second distance includes:

an element fixed to the mandrel;

a stop adjustably carried by the element;

a stop plate mounted with the apparatus, the element extending through a hole in the stop plate, the hole being of a diameter that will not admit the stop, the stop to alter the second distance to alter a bend angle of the sheet stock.

11. The apparatus of claim 10, where the means for moving the mandrel a second distance further includes a at least one collar engagable with the element, the collar being of a size that will not permit the collar to pass through the hole.

12. A method of stretch bend forming sheet stock, said method comprising the steps of:

providing a first clamp movable between a first position and a second position;

providing a second clamp spaced from the first clamp and movable between a first position and a second position;

providing a mandrel;

mounting the mandrel intermediate the first and second clamps for movement between a first position and a second position;

mounting the first and second clamps with the mandrel for free movement in response to movement of the mandrel with the first and second clamps, engaging a piece of sheet stock at spaced-apart points along a length thereof in one of the first and second positions thereof to support the sheet stock in substantial opposition to the mandrel; and moving the mandrel between the first and second positions to engage the sheet stock intermediate the spaced-apart points in one of the first and second positions, the combined movement of the mandrel and the free movement of the first and second clamps cooperating together to bend the sheet stock in one of the first and second positions of the mandrel.

13. The method of claim 12, wherein the step of providing a first clamp further includes the step of providing a pair of opposing faces movable between the first and second positions for engaging the sheet stock in one of the first and second positions.

14. The method of claim 13, the sheet stock further including corrugations, further including the step of providing the opposing faces of the first clamp with wales to engage and mate with the corrugations of the sheet stock.

15. The method of claim 12, wherein the step of providing a second clamp further includes the step of providing a pair of opposing faces movable between the first and second positions for engaging the sheet stock in one of the first and second positions.

16. The method of claim 15, the sheet stock further including corrugations, further including the step of providing the opposing faces of the second clamp with wales to engage and mate with the corrugations of the sheet stock.

17. The method of claim 12, the sheet stock further including corrugations, wherein the step of providing a mandrel further includes the step of providing the mandrel with a face having wales to engage and mate with the corrugations of the sheet stock.

18. The method of claim 12, further including the steps of:

aligning the sheet stock with the first clamp; and aligning the sheet stock with the second clamp.

19. The method of claim 12, wherein the step of moving the mandrel between the first and second positions further includes the steps of:

moving the mandrel a first distance toward one of the first and second positions to bring the mandrel into contact with the sheet stock; and moving the mandrel a second distance toward one of the first and second positions to bend the sheet stock.

20. The method of claim 19, wherein the step of moving the mandrel a second distance further includes the steps of:

providing an element fixed to the mandrel;

providing a stop adjustably carried by the element; and providing a stop plate mounted with the apparatus, the element extending through a hole in the stop plate, the hole being of a diameter that will not admit the stop, the stop to alter the second distance to alter a bend angle of the sheet stock.

21. The method of claim 20, wherein the step of moving the mandrel a second distance further includes the step of providing at least one collar engagable with the element, the collar being of a size that will not permit the collar to pass through the hole.

22. A method for altering a degree of bending of sheet stock, performed with an apparatus for stretch bend forming sheet stock, wherein the apparatus comprises:

a first clamp movable between a first position and a second position;

a second clamp spaced from the first clamp and movable between a first position and a second position;

a mandrel mounted intermediate the first and second clamps for movement between a first position and a second position, the first and second clamps each mounted with the mandrel for free movement in response to movement of the mandrel; and means for moving the mandrel between the first and second positions;

an element fixedly coupled with the mandrel;

a stop adjustably carried by the element; and a stop plate mounted with the apparatus, the element extending through a hole in the stop plate, the hole being of a diameter that will not admit the stop therethrough, the method comprising the steps of:

with the first and second clamps, engaging a piece of sheet stock at spaced-apart points along a length thereof in one of the first and second positions thereof to support the sheet stock in substantial opposition to the mandrel;

moving the mandrel a first distance in a first direction to bring said mandrel into contact with the sheet stock intermediate the spaced-apart points;

moving the mandrel a second distance to bend the sheet stock intermediate the spaced-apart points; and adjusting said stop to alter the second distance to alter a bend angle of the stock.

23. The method of claim 22, wherein the apparatus further includes a plurality of collars engagable with the element, each of the plurality of collars being of a size that will not permit passage thereof through the hole, wherein each of the plurality of collars corresponds to a predetermined stopping distance and therefore a predetermined degree of bend, the method further comprising steps of:

selecting a one of the plurality of collars having a length corresponding to a predetermined second distance;

installing the selected one on the element; and bending the sheet stock to a predetermined angle corresponding to the selected one.

* * * * *

UNITED STATES PATENT AND TRADEMARK OFFICE

CERTIFICATE OF CORRECTION

PATENT NO. : 5,860,314

DATED : 19 JANUARY 1999

INVENTOR(S) : JOHN POWERS, III

It is certified that error appears in the above-indentified patent and that said Letters Patent is hereby corrected as shown below:

REPLACE "stop support" in column 13, line 15 with --stop plate--.

Signed and Sealed this

Twenty-sixth Day of October, 1999

*Attest:*

Q. TODD DICKINSON

*Attesting Officer*

*Acting Commissioner of Patents and Trademarks*